US005228616A

United States Patent [19]

Kjelgaard

[11] Patent Number: 5,228,616

[45] Date of Patent: Jul. 20, 1993

[54] PACKAGE CONTAINER PROVIDED WITH A STRIP-TYPE OPENING ARRANGEMENT

[75] Inventor: Tom Kjelgaard, Lund, Sweden

[73] Assignee: Tetra Alfa Holdings S.A., Pully, Switzerland

[21] Appl. No.: 808,974

[22] Filed: Dec. 17, 1991

Related U.S. Application Data

[63] Continuation of Ser. No. 743,742, Aug. 12, 1991, abandoned.

[30] Foreign Application Priority Data

Aug. 14, 1990 [SE] Sweden ..... 9002640

[51] Int. Cl.[5] ..... B65D 5/70

[52] U.S. Cl. ..... 229/123.1; 229/238; 229/125.37

[58] Field of Search ..... 229/123.1, 123.2, 216, 229/238, 125.37

[56] References Cited

U.S. PATENT DOCUMENTS

| | | | |
|---|---|---|---|
| 3,104,798 | 9/1963 | Stone | 206/633 |
| 3,713,849 | 1/1973 | Grindrod et al. | 229/123.1 |
| 3,827,625 | 8/1974 | Miller | 206/631 |
| 4,433,784 | 2/1984 | Kjelgaard | 206/633 |
| 4,762,234 | 8/1988 | Wyberg | 206/631.2 |
| 4,787,507 | 11/1988 | Rausing | 206/633 |
| 4,872,562 | 10/1989 | Wyberg | 206/631.2 |
| 4,884,695 | 12/1989 | Kjelgaard | 229/123.1 |
| 4,989,736 | 2/1991 | Andersson et al. | 229/123.1 |

FOREIGN PATENT DOCUMENTS

| | | |
|---|---|---|
| 0352245 | 6/1989 | European Pat. Off. . |
| 451064 | 8/1987 | Sweden . |
| 459916 | 8/1989 | Sweden . |

*Primary Examiner*—Gary E. Elkins
*Attorney, Agent, or Firm*—Burns, Doane, Swecker & Mathis

[57] ABSTRACT

A package container fabricated from plastic-coated packaging material includes an upper end wall and a sealing fin that extends across the upper end wall of the container. The sealing fin includes mutually facing material layers between which is located an opening strip. The opening strip includes an inner layer positioned between outer layers that are sealed to plastic coatings of the packaging material, and an intermediate layer positioned between the inner layer and each of the outer layers. The intermediate layer is fabricated from a material whose properties are such that the adhesive bonding strength between all material layers of the opening strip and between the outer layers of the opening strip and the plastic coating of the packaging material is greater than the internally cohesive bonding strength of the intermediate layer.

14 Claims, 1 Drawing Sheet

PACKAGE CONTAINER PROVIDED WITH A STRIP-TYPE OPENING ARRANGEMENT

This application is a continuation of application Ser. No. 07/743,742, filed Aug. 12, 1991, abandoned.

FIELD OF THE INVENTION

The present invention relates to an opening arrangement in a package container. More particularly, the present invention pertains to an opening arrangement in a package container produced from plastic-coated packaging material of the type which has a sealing fin extending transversely over a container wall, in which sealing fin the plastic coatings of opposing packaging material layers are united to one another in a sealing joint or splice, the packaging material layers accommodating, along at least a part of the sealing fin, an opening strip inlaid in the sealing fin, the strip being of a laminated material comprising an inner layer sandwiched between outer layers of a material sealed with good adhesion to the plastic coating of the packaging material.

BACKGROUND OF THE INVENTION

Within the field of packaging technology and engineering, use is often made of single-use disposable packages or cartons produced from plastic-coated packaging material for packing and transporting liquid foods such as milk, juice, wine etc. The exact structure of such a packaging material varies depending upon what product is to be packed, but generally includes one or more body or carrier layers of paper or cardboard which impart to the package the requisite rigidity and configurational stability, and outer coatings of a thermoplastic, preferably polythene, which not only make the package liquid-tight but also make it possible to give the package its permanent desired geometric final form by means of so-called heat sealing.

Nowadays, disposable packages of the type contemplated here are most generally produced by means of modern, rational packaging machines which, either from a web or from prefabricated blanks of the packaging material, forms, fills and seals finished packages. For example from a web, packages of the Tetra Brik ® type are produced in that the Web is first formed into a tube by the longitudinal edges of the web being united to one another in a longitudinal overlap seal or splice. The tube is filled with the desired contents and divided into closed package units by repeated transverse seals of the tube along mutually spaced-apart transverse tube zones beneath the level of the contents of the tube. The particular cushion-like packages are thereafter given their desired geometic final form (in this specific case parallel-epipedic) by an additional fold forming and sealing operation during which four double-walled triangular tabs or flaps occur at the corners of the package. Of these flaps, both of the upper corner flaps of the package are folded down and sealed to adjacent vertical side walls, while both of the lower corner flaps of the package are folded in and sealed against the planar bottom wall of the package.

The described prior art parallelepipedic package thus displays two sealing fins occasioned by transverse sealing of the tube, in which fins opposing material layers of the packaging material are united to one another inside-to-inside in a sealing splice formed by surface fusion. One of these two sealing fins is, in such instance, located at the planar upper wall of the package, transversely over which it extends from tip to tip of both of the upper corner flaps folded down towards the side walls of the package and sealed. The other sealing fin is correspondingly located at the bottom wall of the package across which it extends from tip to tip of both of the lower corner flaps folded in towards the bottom wall of the package and sealed. Moreover, the package has a longitudinal sealing splice which constitutes a part of the longitudinal overlap splice of the produced tube and which intersects the above-mentioned transverse sealing fins at a point between both of the corner flaps at the upper and lower end walls of the package, respectively.

The demands placed on a disposable package of the type described here are, of course, that it must provide as good protection as possible to the packed product, but also that it must be easy to handle during both transport and use. In order to make the package easy to handle when using, it is often provided with some type of opening arrangement with the aid of which the contents of the package must be made easily accessible and easy to pour from the package in a single, well-directed stream.

In the above-described package of the Tetra Brik ® type, use is here most generally made of one of the two upper triangular corner tabs or flaps of the package as the pour aperture or spout, the package proper being normally opened in that this corner flap is released and raised from its position folded down towards the side wall of the package and that the sealing fin extending over the corner flap is torn or cut off so that a communication channel is established with the interior of the package.

Since a certain degree of difficulty may be experienced in tearing the above-mentioned triangular flap along a prepared tear indication or perforation, and since cutting off the sealing fin presupposes access to some form of utensil, a solution to the problem of opening such packages has instead been proposed in the art, using a tear thread or tear strip of the type described, for example, in Swedish Patent Specification 402,899. In such instance, the tear thread or tear strip is inlaid in the sealing fin from the tip of the triangular corner flap which serves as the pouring aperture or spout, up to and past the point of intersection of the sealing fin with the longitudinal overlap splice of the package so that the tear thread or tear strip becomes accessible from the outside of the package. When the package is to be opened, the exteriorly accessible portion of the tear thread or tear strip is drawn upwardly and rearwardly, whereby the sealing splice in the sealing fin between the above-mentioned point of intersection and the tip of the triangular corner flap is severed, for the formation of a corresponding pour aperture.

However, this prior art thread- or strip-assisted opening form of package has proved to function less satisfactorily, primarily because the thread or strip seldom cuts directly in the sealing splice but instead cuts between the paper material and the plastic coating on one of the material layers. As a result the paper or cardboard layer of the packaging material is exposed so that the contents of the package come into contact with the absorbent, exposed fiber surface which rapidly becomes soggy and loses rigidity.

Another prior art solution to the problem of opening packages of the type comtemplated here is described in, for example, European Patent Application carrying Publication Number 0083441. In this case, the opening arrangement consists of a strip of laminated material which is inlaid in the sealing fin and comprises partly an inner layer of a material of high tensile strength and tearing resistance, eg. oriented polyester, nylon, metal foil, etc., and partly outer coatings of a heat sealable plastic material, preferably polythene, disposed on either side of the inner layer. In such instance, the opening strip extends, like the above-described tear thread or tear strip, from the tip of the corner flap serving as the pouring aperture or spout, up to and past the point of intersection between the sealing fin and the longitudinal overlap splice of the package and is, by means of the outer thermoplastic coatings of the opening strip, fixedly sealed to the opposing thermoplastic coatings of the package within the region of that portion of the sealing fin accommodating the strip. Since, in sealing terms, the material in the inner layer of the opening strip is hardly compatible, or totally incompatible, with the outer thermoplastic coatings of the opening strip, the inner layer of the opening strip is subjected to some form of adhesion-improving pretreatment, so-called priming, and/or a suitable sealing temperature is selected, to achieve the desired sealing strength or bond between the inner layer of the opening strip and its outer thermoplastic coatings. The demand placed in this instance is that the sealing strength between the inner layer of the opening strip and its outer thermoplastic coatings must be weaker than the sealing strength between the outer thermoplastic coatings of the opening strip and the thermoplastic coatings of the packaging material proper, while at the same time the sealing strength must be sufficiently great to prevent spontaneous delamination of the opening strip when the package is subjected to external stresses during normal transport and handling.

The opening procedure in a package with a laminated opening strip of the above-described type is based on the concept that the opening strip, on tearing of the sealing fin, is to delaminate in the interface layer between the inner layer and the outer thermoplastic coatings, for exposing the inner layer which is pulled off, at the same time as both of the outer thermoplastic coatings are left adhered against the packaging material in the region of the pouring aperture created. The problem in this prior art form of opening strip is that, in practice, it has proved difficult to optimize the adhesion strength between the inner layer of the opening strip and its outer thermoplastic coatings, and, in order to avoid an excessively low adhesive strength and consequential risk of spontaneous or unintentional delamination of the opening strip, the adhesion pretreatment or priming of the inner layer of the opening strip and/or the sealing temperature governing the adhesion strength are often intentionally selected such that an excessively great binding strength between the inner layer and the outer thermoplastic coatings becomes inevitable. This in turn entails that the opening strip becomes difficult to pull off without applying extreme tensile forces and/or that pulling-off of the opening strip not uncommonly results in the inner thermoplastic coatings of the packaging material proper also being pulled-off, whereby the fiber layers of the packaging material are exposed within the region of the pouring aperture or spout.

Swedish Patent Specification 459,916 describes another prior art opening principle using a laminated opening strip which, in analogy with the previously described opening strip, includes an inner layer of a material of good tensile strength and tearing resistance, preferably polyester, and outer coatings of sealable plastic material, preferably polythene. In such instance, the adhesion strength between all of the material layers included in the opening strip is intentionally high, with a view to making possible pulling-off of the opening strip Without delamination between the layers in the opening strip. Instead, easy pull-off of the opening strip is ensured without requiring the employment of excessive physical force in that the packaging material, in that portion of the sealing fin accommodating the strip, has been provided with a seal-weakening agent, eg. water glass, localized between the fiber layers of the packaging material and its inner thermoplastic coating, whereby the sealing strength between the packaging material layers is reduced in such a manner that the bonding strength between the outer thermoplastic coatings of the opening strip and the inner thermoplastic coatings of the packaging material is higher than the bonding strength between the fiber layers of the packaging material and its inner thermoplastic coating. Thus, on pulling-off of the opening strip, the plastic coatings within the seal-weakened region of the sealing fin will also be torn off and accompany the opening strip, at the same time as the fiber layer at least partly impregnated with the water glass is exposed within the region of the pouring aperture. In order to function well, this opening arrangement presupposes that at least the major portion of the thus exposed fiber surface is impregnated with the moisture and liquid-protective water glass film, but in practice it has proved difficult to satisfy this requirement and it is not uncommon that the fiber surface, after tearing-off of the opening strip, is left without adequate protection.

OBJECT OF THE INVENTION

The object of the present invention is, therefore, to propose a novel type of opening arrangement by means of which the above-discussed problems may be effectively obviated.

SUMMARY OF THE INVENTION

This object is attained according to the present invention in that an opening arrangement of the type described by way of introduction is designed such that the opening strip displays, between the inner layer of the opening strip and each respective outer layer, an intermediate layer of a material of such properties that the adhesive bonding strength between all of the material layers included in the opening strip and between the outer layer of the opening strip and the plastic coating of the packaging material is greater than the internally cohesive bonding strength of the intermediate layer.

Hence, the opening arrangement according to the present invention operates on the principle that the opening strip is to delaminate completely within one material layer included in the opening strip, as opposed to the previously described prior art opening arrangements according to which the opening strip, in the first-mentioned case, is to delaminate between two material layers included in the opening strip, and, in the latter case, to delaminate between two material layers included in the packaging material, i.e. the fiber layer and the thermoplastic coating, while the opening strip per se is not to be delaminated, but to be torn off intact.

The internal or cohesive delamination in one of the material layers of the opening strip affords inter. alia, the advantage that the opening strip according to the present invention may be removed without the packaging material proper being affected or destroyed in the region of the opening, the fiber layers of the packaging material instead remaining well-protected by the enduring, intact thermoplastic coating of the packaging material and, to some degree, even extra protected by that part of the internally or cohesively delaminated material layer of the opening strip which remains adhering to the thermoplastic coating of the packaging material after tear-off of the opening strip, at the same time as the internal or cohesive bonding strength in the delaminable intermediary layer of the opening strip may readily be adjusted so that the opening strip is easy to pull-off without the need of applying excessively great tensile forces.

According to one preferred embodiment of the present invention, the cohesively delaminable intermediary layer of the opening strip consists of a physical mixture of polythene and polybutene, i.e. a mixture in which both of the above components are Only physically admixed to one another without any element of chemical interreaction or other structural bonding between the components. The proportions of each respective component included in the intermediary layer are determined by the desired cohesive bonding strength of the material and are selected according to the present invention such that the previously discussed optimization requirement between spontaneous or unintentional opening and intentional opening is satisfied. According to the invention, the proportion of polybutene in the intermediary layer should amount to between 10 and 50 weight per cent, since an intermediary layer containing less than 10 weight per cent of polybutene would require an excessively high tensile force to delaminate, while an intermediary layer containing more than 50 weight per cent would be far too easily delaminable and entail increased risk of spontaneous or unintentional opening of the package container. A particularly well optimated intermediary layer should, according to the invention, contain approx. 25 weight per cent of polybutene.

BRIEF DESCRIPTION OF THE ACCOMPANYING DRAWINGS

The present invention will be described in greater detail hereinbelow, with particular reference to the accompanying Drawings, in which like elements bear like reference numerals and wherein.

DESCRIPTION OF PREFERRED EMBODIMENT

Figure 1:
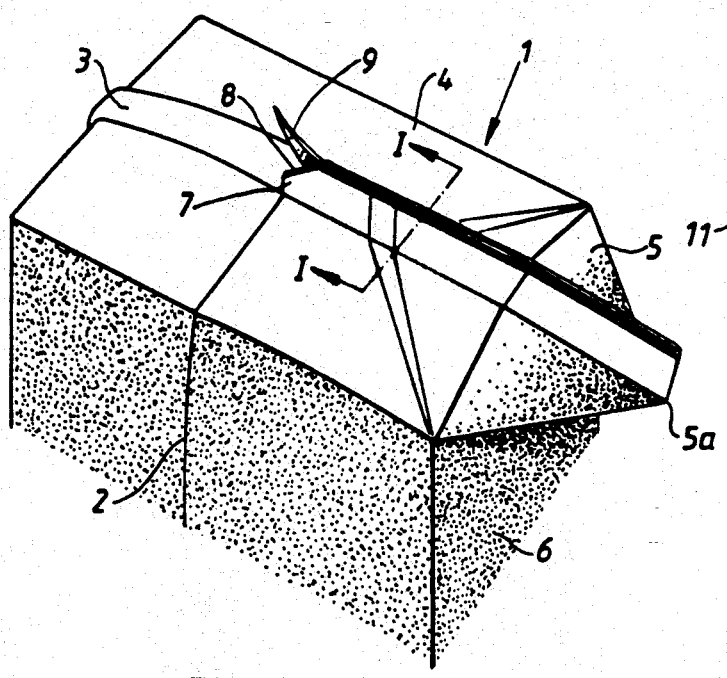
FIG. 1 is a perspective view of the upper region of an unopened package container with an opening arrangement according to the present invention.
Figure 2:
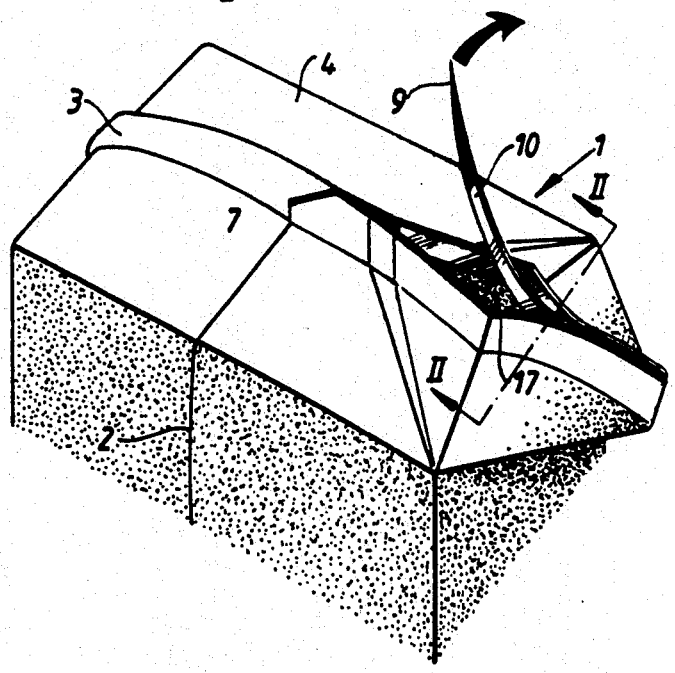
FIG. 2 is a perspective view of the package container in the process of being opened.

The package container 1 shown in FIGS. 1 and 2 is of the previously described Tetra Brik® type.

The package container 1 has a longitudinal sealing splice 2 of the overlap type and a sealing fin 3 which extends along the upper end wall 4 of the package container 1. As illustrated, the package container has a triangular, double-walled flap 5 which is intended to function as the pouring aperture or spout and, in FIG. 1, the triangular flap has been separated and partly raised from the side wall 6 of the package container against which the flap 5 is downwardly folded and sealed in the unopened package.

At the point of intersection 7 between the longitudinal splice and the transverse sealing fin 3, the edge of the overlapping material is cut obliquely along the region 8 and, in the point of intersection 7, a portion 9 of an opening strip 10 that is inlaid in the fin 3 projects out. The projecting strip portion 9 may suitably be designed as or provided with a pull-ring or eye by means of which pull-off of the strip is facilitated.

Figure 3:
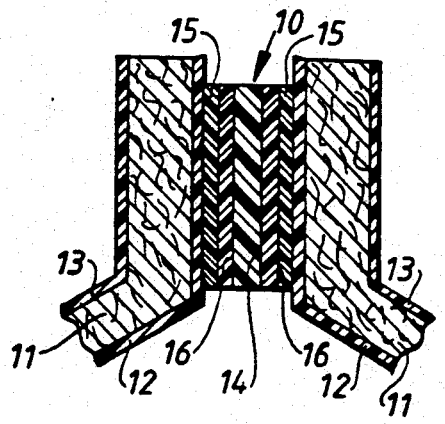
FIGS. 3 and 4 are cross-sectional views of the package container according to FIGS. 1 and 2 taken along the section lines I—I and II—II, respectively.
Figure 4:
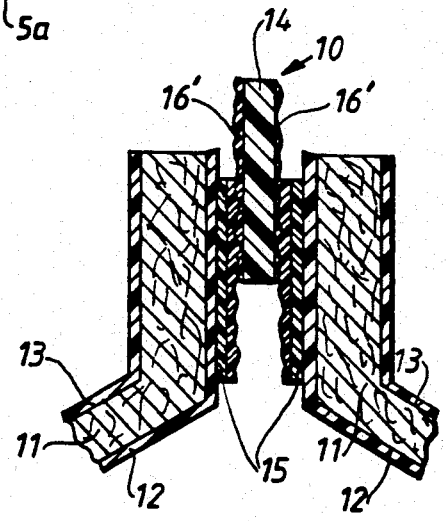

As is apparent from FIG. 3, and partly also from FIG. 4, which show greatly magnified cross-sections of the package container 1 taken along the lines I—I and II—II, respectively, the package container 1 is produced from a packaging laminate comprising a body or carrier layer 11 of paper or cardboard and outer thin coatings 12 and 13 of thermoplastic, preferably polythene. The mutually facing material layers of the sealing fin 3 accommodate therebetween the strip 10 which is inlaid in the sealing fin along a region which extends from the tip 5*a* of the double-walled triangular corner flap 5 to the intersection point 7 between the longitudinal splice 2 and the sealing fin 3. At the intersection point 7, the strip 10 is accessible by means of the projecting strip portion 9 which is preferably in the form of an eyelet or loop.

In the illustrated example, the strip 10 consists of a laminated material containing an inner layer 14 of plastic material of high tensile strength, preferably polyester, as well as outer coatings 15 of sealable plastic material, preferably polythene. Furthermore, the strip 10 is sealed with good adhesion to the surrounding material layers of the sealing fin 3 by surface fusion between the outer plastic coatings 15 of the strip and the opposing, inner plastic coatings 12 of the material layers.

In order to make for the ready pull-off of the strip 10 when the package is to be opened, the strip 10 is provided, between the inner layer 14 and each respective outer thermoplastic coating 15, with an intermediate layer 16 of a material of such properties that the adhesive bonding strength between all material layers included in the opening strip and between the outer layer 15 of the opening strip and the plastic coating 12 of the packaging material is considerably greater than the internally cohesive bonding strength in the intermediate layer 16. In the embodiment presented here, the intermediate layer 16 consists of a physical mixture of polythene and polybutene containing between 10 and 50, preferably approx. 25 weight per cent of polybutene. It is further assumed that the intermediate layer 16 is produced by extrusion in such a manner and under such conditions that no structural or chemical bonding takes place between the two components included in the mixture. By the admixture of polybutene in the above-mentioned mixing ratio in the intermediate layer 16, it is thus possible, according to the present invention, to bind together all material layers included in the opening strip and also to fixedly seal the opening strip to the inner thermoplastic coating 12 of the packaging material in the region of that portion of the sealing fin accommodating the strip, with considerably greater bonding strength than the internal cohesive bonding strength of the intermediate layer 16.

When the package container 1 is to be opened, the procedure illustrated in FIGS. 1 and 2 is followed. First, the double-walled triangular corner flap 5 that is sealed against the side wall 6 is raised so that it lies substantially flush with the upper end wall 4 of the package container, as shown in FIG. 1. Thereafter, the freely projecting end 9 is grasped at the intersection point 7 between the longitudinal splice 2 of the package and the transverse sealing fin 3, by means of which end the opening strip 10 is pulled upwardly and rearwardly, to the right in FIG. 2, with a tensile force which is greater than the above-mentioned internal cohesive bonding strength of the intermediate layer 16, whereby the opening strip delaminates internally within each respective intermediate layer 16 for exposing a pouring aperture 17. As is apparent from FIG. 4, the pulled-off opening strip thus comprises the inner layer 14 and accompanying portions 16' of the delaminated intermediate layer 16 on both sides of the inner layer, while remaining portions of this layer, together with the outer thermoplastic coatings 15 of the opening strip remain adhered to the otherwise intact and unaffected packaging material within the region of the pouring aperture 17.

Practical experiments have shown that a package container 1 according to the present invention is very easy to open with the aid of the inlaid opening strip 10, without mobilizing excessive force and without the risk of adhesive delamination or derangement of the opening strip 10. Furthermore, the opening procedure is effectuated in such a manner that no part of the absorbent paper or cardboard fibers of the packaging material is exposed or even risks being exposed within the opening region.

The present invention should not be considered as restricted to that described above and shown on the Drawings, many modifications being conceivable without departing from the spirit and scope of the appended Claims.

What is claimed is:

1. A package container fabricated from plastic-coated packaging material and comprising an upper end wall and a sealing fin that extends over the upper end wall of the container, said sealing fin including mutually facing material layers between which is located an opening strip, said opening strip extending along at least a part of said sealing fin, said opening strip including an inner layer positioned between outer layers that are sealed to the plastic coating of the facing material layers of the packaging material, and an intermediate layer positioned between the inner layer and each of the outer layers, said intermediate layers being fabricated from a material whose properties are such that the adhesive bonding strength between all material layers of the opening strip and between the outer layers of the opening strip and the plastic coating of the facing material layers of the packaging material is greater than the internally cohesive bonding strength of the intermediate layers.

2. The package container according to claim 1, wherein said intermediate layer of the opening strip comprises a mixture of polythene and polybutene.

3. The package container according to claim 2, wherein the intermediate layer of the opening strip contains between about 10 weight per cent and about 50 weight per cent of polybutene.

4. The package container according to claim 1, wherein the outer layers of the opening strip are fabricated of plastic material, the plastic coating of the packaging material and the plastic material from which the outer layers of the opening strip are fabricated including polythene, said opening strip being secured to the packaging material layers by surface fusion between the plastic coating of the packaging material and the outer layers of the opening strip.

5. The package container according to claim 1, wherein said inner layer of the opening strip is fabricated from a material having high tensile strength and tearing resistance.

6. The package container according to claim 1, wherein the inner layer of the opening strip is fabricated from polyester, polypropylene or oriented polypropylene.

7. The package container according to claim 1, wherein the inner layer of the opening strip is fabricated from polyester.

8. The package container according to claim 1, wherein said inner layer of the opening strip is primed to achieve adequate adhesion between the inner layer of the opening strip and the intermediate layers.

9. An opening arrangement in a package container that is fabricated from a plastic-coated packaging material and that includes a sealing fin which extends across an end wall of the container and includes mutually facing material layers, said opening arrangement comprising an opening strip that is to be pulled relative to the remainder of the container to effect opening of the container, said opening strip being positioned between the mutually facing material layers of the sealing fin, said opening strip including an inner layer, two outer layers and two intermediate layers, each of said outer layers being secured to the plastic coating on one of the mutually facing material layers, and each of said intermediate layers being positioned between and secured to said inner layer and one of said outer layers.

10. The opening arrangement according to claim 9, wherein each of said intermediate layers includes means for ensuring that when said opening strip is pulled in order to effect opening of the container the intermediate layers delaminate internally so that the inner layer and a portion of each intermediate layer become separated from remaining portions of the intermediate layers which remain secured to their respective outer layers.

11. The opening arrangement according to claim 10, wherein said means includes said intermediate layers being fabricated from a mixture of two materials that are mixed with one another so that chemical and structural bonding of the two materials is avoided.

12. The opening arrangement according to claim 11, wherein said mixture of two materials includes polybutene.

13. The opening arrangement according to claim 11, wherein said means includes the adhesive bonding strength between all of the layers forming the opening strip and between the outer layer of the opening strip and the plastic coating on the mutually facing material layers being greater than the internal cohesive bonding strength in the intermediate layers.

14. The opening arrangement according to claim 10, wherein a portion of said opening strip projects outwardly from the sealing fin so as to define a freely projecting end of the opening strip that can be grasped and pulled to effect opening of the container.

* * * * *